US006006732A

United States Patent [19]

Oleksiewicz

[11] Patent Number: 6,006,732

[45] Date of Patent: Dec. 28, 1999

[54] BALANCED FLOW EGR CONTROL APPARATUS

[75] Inventor: Radek A. Oleksiewicz, Riverwoods, Ill.

[73] Assignee: Navistar International Transportation Corp, Chicago, Ill.

[21] Appl. No.: 09/145,874

[22] Filed: Sep. 3, 1998

[51] Int. Cl.[6] ..... F02M 25/07

[52] U.S. Cl. ..... 123/568.2; 123/568.11; 123/568.23

[58] Field of Search ..... 123/568.11, 568.18, 123/568.2, 568.21, 568.19, 568.23, 568.24, 568.26

[56] References Cited

U.S. PATENT DOCUMENTS

| | | | |
|---|---|---|---|
| 2,014,968 | 9/1935 | Hughes . | |
| 2,717,003 | 9/1955 | Jay et al. . | |
| 3,530,843 | 9/1970 | Fessenden | 123/568.11 |
| 3,884,268 | 5/1975 | Wagner et al. . | |
| 4,142,492 | 3/1979 | Kobayashi et al. | 123/568.11 |
| 4,350,013 | 9/1982 | Yoshiba | 123/568.2 |
| 4,506,633 | 3/1985 | Britsch | 123/568.11 |
| 5,388,613 | 2/1995 | Kruger . | |
| 5,562,086 | 10/1996 | Asada et al. | 123/568.21 |
| 5,762,051 | 6/1998 | Okamoto | 123/568.2 |
| 5,911,681 | 6/1999 | Tanaka et al. | 123/568.21 |

*Primary Examiner*—Willis R. Wolfe
*Attorney, Agent, or Firm*—Dennis K. Sullivan; Jeffrey P. Calfa

[57] ABSTRACT

An internal combustion engine of the V-type configuration includes a balanced flow EGR control apparatus having a valve comprising a stem having two linearly aligned, substantially similarly plug valve bodies engaged thereto with a predetermined distance therebetween. The valve housing has separate ports for receiving exhaust flow from each cylinder bank and a common outlet passageway communicating with the intake manifold, the ports being in linear alignment. One valve body is disposed to plug the exhaust port from the exhaust port side while the other valve body plugs the other exhaust port from the intake outlet side. Each valve body is configured, sized and positioned over a respective port in a manner where pressure of flow against one valve body effectively cancels out the pressure of flow against the other valve body, producing a valve that is easily maintained in an appropriate seated position thereof and opened with minimum force. The apparatus is disclosed in two embodiments, one of which accommodates rotary actuation and another of which accommodates linear actuation, with each embodiment being operable under control of an engine ECU in response to readings of operational parameters of the engine.

16 Claims, 1 Drawing Sheet

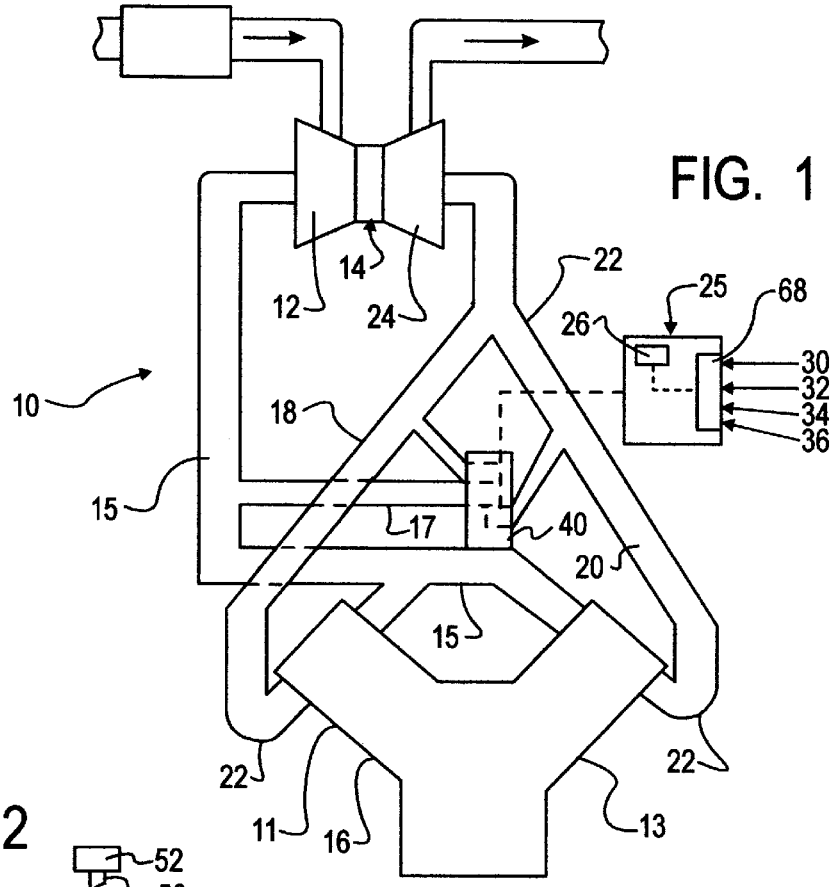
FIG. 1
FIG. 2
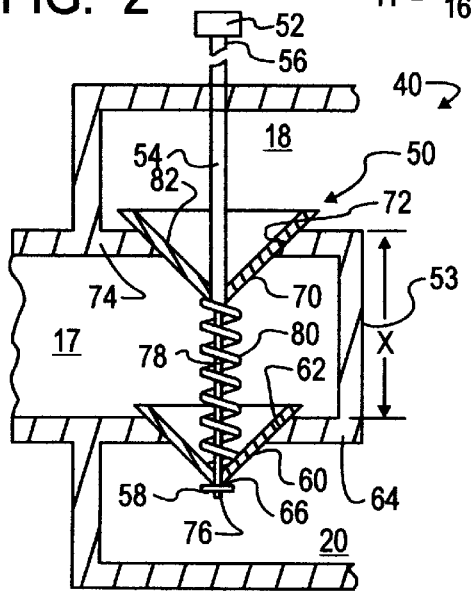
FIG. 3
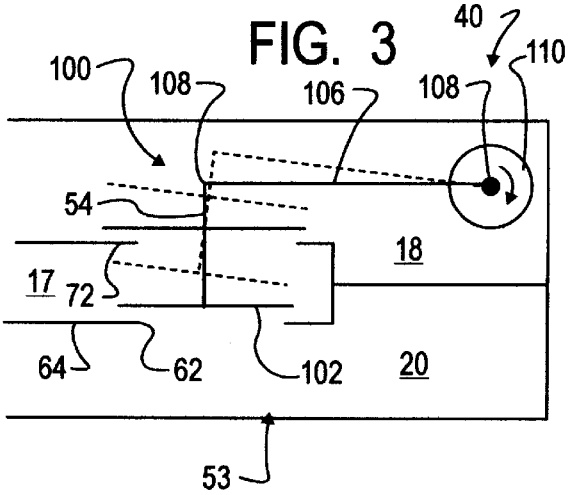

BALANCED FLOW EGR CONTROL APPARATUS

BACKGROUND OF THE INVENTION

The present invention relates to internal combustion engines, particularly engines of the V-type having two banks of cylinders, and more particularly to a controllable porting apparatus for an exhaust gas recirculation (EGR) system for an engine where there are two sources of pressurized flow, one from each bank, merging into one outflow stream to the intake manifold wherein the porting apparatus includes a valve of such configuration that the force of the pressurized flow from one bank acting upon one surface thereof effectively cancels out the opposed force of the pressurized flow from the other bank acting upon an opposing surface thereof.

THE PRIOR ART

Although balanced valve arrangements per se are known, for example, in U.S. Pat. Nos. 2,014,968; 2,717,003; 3,884,268; and 5,338,613, it is not known to incorporate such arrangements in internal combustion engines or in EGR systems, to produce a valve structure requiring decreased force to maintain same closed or to open same, while at the same time balancing the flow from both banks in response to control signals from an ECU of the engine and maintaining the engine at an optimal level of performance.

SUMMARY OF THE INVENTION

Accordingly, it is a primary object of the invention to provide an EGR flow control apparatus for an internal combustion engine which includes a valve that is balanced by its configuration to effectively cause cancellation of the forces resulting from two separate and opposing sources of pressurized flow acting thereupon while also balancing the controlled level of flow from the cylinder banks.

This object, as well as others which may become more apparent hereinafter, is specifically met by the EGR porting apparatus of the present invention which includes an internal combustion engine of the V-type having two banks of cylinders, each bank having a source of exhaust flow which engages a respective inlet port in a valve housing having a common outlet connected to an intake manifold, and a valve having a pair of valve bodies which are linearly aligned and engaged upon a single stem, one of which closes an inlet port from the exhaust side and the other of which closes the inlet port from the intake manifold side so that pressure in the first path of exhaust flow acting upon the valve effectively cancels out an equal and opposite pressure in the second path of exhaust flow acting upon the valve, thereby resulting in the valve being easily opened or closed, as well as balancing flow from the banks into the common destination in response to signals from an ECU, the flow being controlled by the ECU so as not to compromise optimal engine performance. Preferably, one valve body is slightly larger than the other to produce a small pressure bias to close the valve.

BRIEF DESCRIPTION OF THE DRAWINGS

FIG. 1 is a simplified diagram of an exemplary exhaust bas recirculation system of engine of V-type configuration incorporating the balanced flow EGR control apparatus and valve of the present invention.

FIG. 2 is a cross sectional view through a linearly actuated embodiment of the valve of the present invention.

FIG. 3 is a cross sectional view through a second embodiment of the valve of the present invention, this embodiment being more suitable for use where rotary actuation is required.

DESCRIPTION OF THE PREFERRED EMBODIMENT

Referring now to the drawings in greater detail, there is illustrated in FIG. 1 a schematically exemplary embodiment of a turbocharged internal combustion engine 16 having an exhaust gas recirculation system generally identified by the reference numeral 10. The engine 16 is of V-type configuration having left and right banks of cylinders 11, 13.

Typically, pressurized air from a compressor 12 of a turbocharger 14 enters a common intake manifold 15 feeding into both banks of the engine 16 where air mixes with fuel which, when compressed by piston action, undergoes combustion, with chemical remnants of combustion, such as NOx, being carried away from the engine 16 via an exhaust manifold 22 of the engine 16 disposed on each bank 11, 13, the exhaust manifolds 22 feeding first and second passages 18 and 20, respectively, connected to a turbine 24 of the turbocharger 14 which drivingly engages the compressor 12 thereof.

To remove the NOx from the engine exhaust gas, such exhaust gas is preferably recirculated back through EGR valve 40 and passage 17 into the intake manifold 15, directly or indirectly, and is reburned, the instantaneous amount of exhaust gas capable of being accommodated for recirculation without compromising optimal engine 16 performance being dependent upon operational parameters of the engine 16 monitored by an ECU 25 thereof. In this respect, if there is an excessive amount of exhaust gas being recirculated into the intake manifold 15, it will cause the engine 16 to operate at a level of performance which is less than optimal, as well as potentially causing damage thereto.

Consequently, the amount of exhaust gas to be recirculated (level of recirculation) is controlled by the ECU 25 in response to sensed operational parameters of the engine 16 as compared to those required for optimal engine 16 performance. The ECU 25 analyzes readings received from various engine sensors, compares the readings to parameter values stored in a memory 26 thereof which are predetermined to produce optimal engine 16 performance and causes necessary actions in various devices controlled thereby to maintain the engine 16 at an optimal level of performance. Specific sensors which could be used in establishing appropriate control of exhaust gas recirculation could be, as an example, one or more of an intake manifold temperature sensor 30, a mass air flow sensor 32, an engine speed sensor 34 and a pedal position sensor 36.

Turning now to FIG. 2, there is illustrated therein a first embodiment of a balanced flow EGR control valve assembly 40 made in accordance with the teachings of the present invention.

As will be understood, this embodiment incorporates a valve 50 which is adapted for use with a linear actuator 52, such as a solenoid 52. As illustrated, there is a valve housing 53 having two separate inlets for pressurized exhaust, such as the first and second passages 18 and 20 of the two engine banks 11,13, and a single outlet port connected to passage 17 connected to the engine intake manifold 15. In a preferred embodiment, the single outlet passage 17 is sandwiched between passage 18 and 20 sharing common walls therewith.

The valve 50 includes an elongate main stem 54 disposed in the housing 53 which engages the linear actuator 52 at a proximal end 56 thereof. At a distal end 58 thereof, a first valve body 60, preferably in the form of a hollow inverted cone, is disposed on the stem and engages within a corresponding first inlet port 62 created in a housing wall 64 common to the second bank passage 20 and the single outflow passage 17 connecting to the intake manifold 15, with a tip portion 66 of the valve body 60 extending into the passage 20.

A second substantially similar valve body 70 is disposed in fixed position on the stem 54 at a position which will ensure secure seating of the second valve body 70 within a second inlet port 72 created in a wall 74 common to the first bank passage 18 and the single outlet path 17. To secure simultaneous engagement of the first valve body 60, the distance between the entrance wall to port 72 and the entrance wall to port 62 must be taken into careful consideration. In this respect, when the ports 62 and 72 and valve bodies 60 and 70 are of identical size, the distance between identical points on each valve body 60 and 70 should equal the dimension X.

However, as shown herein, it may be desirable to provide valve bodies 60, and 70, and/or ports 62, and 72 which are of dissimilar size, or to accommodate thermal expansion or tolerance variations in the parts. In such a situation, it is contemplated to slidingly dispose the first valve body 60 on the distal end 58 or, alternatively, to engage the first valve body 60 at a free end 76 of a telescoping terminal stem portion 78 (substituting for distal end 58 of main stem 54) while securing the second valve body 70 directly onto the main stem 54, a biasing spring 80 being disposed either between the valve bodies 60, 70 or between the telescoping terminal stem portion 78 and the main stem 54 from within which the terminal stem portion 78 extends, the spring 80 biasing the first valve body 60 into the corresponding port 62, regardless of the size of the port 62 (obviously not of an extent greater than that of the valve body 60), by over-accommodating slightly for the dimension X. It will be understood that a length of the telescoping stem portion 78 must be limited so as not to interfere with opening of the valve port 62 engaged by the first valve body 60 when the main valve stem 54 is retracted by the associated actuator 52.

In the embodiment disclosed, the port 62 engaging the first valve body 60 is shown as being of a diameter less than a diameter of the second port 72 and its corresponding valve body 70, such smaller first valve body 60 easing passage thereof through the larger diameter second port 72 during installation of the valve 50 into the EGR apparatus 40.

Turning now to the aspect of the valve 50 being balanced, it will first be understood that the air pressure against an open end or inner surface 82 of the second valve body 70 produces a force that assures a sealing engagement of the second valve body 70 within the corresponding port 72.

This force is translated down the length of the terminal stem portion 58, 78 and, by virtue of the biasing spring 80, also ensuring a sealing engagement of the first valve body 60 within the corresponding port 62.

Further, because pressure is applied against the smaller outer surface area 66 defining a tip 66 of the first valve body 60, this pressure will necessarily be at least overcome by the pressure applied against the larger area of the inner surface 82 of the second valve body 70, biasing the valve 50 to be appropriately seated. Further, even if the biasing spring 80 were not incorporated in the telescoping stem configuration, pressure applied against the tip 66 of the first valve body 60 will be compensated for by the pressure applied against the inner surface 82 of the second valve body 70, the valve 50 thus remaining balanced between the opposing forces acting thereupon. Since the exhaust pressure forces offset, a small amount of force equal to the difference between the force on surface 82 and the force on the outer surface 66 is all that is required of actuator 52 to open the valve 50 when commanded to do so by the ECU 25.

Turning now to FIG. 3, there is illustrated therein a second embodiment of the apparatus 40 wherein a balanced valve 10 thereof, also made in accordance with the teachings herein, is particularly suited for use in an environment requiring rotary actuation of the valve 100.

In this embodiment, first and second valve bodies 102 and 104, respectively are configured to define plate-like members which seat across and seal a corresponding ports 62 and 72, with a separation therebetween again equal to the distance X and a similar telescoping stem, with or without a biasing spring, to the embodiment of FIG. 2 being employed. The valve stem 54 here, however, incorporates a terminal arm 106 extending radially outwardly from a proximal end 108 of the stem 54, the arm 106 terminating in a rotary connector 108 such as a shaft 108, allowing for engagement of the valve stem 54 to an appropriate rotary actuator 110.

The rotary force of the actuator 110 applied to the connector 108, at the end 108 of the terminal arm 106, produces a vertical pivoting of the arm 106 about the connector 108 with the stem 54 attached to the arm 106 pivoting out of closure of the ports 62 and 72, with the maintained alignment between the valve bodies 102 and 104 causing their disengagement from their seated positions across the respective ports 62 and 72.

With respect to being a balanced valve 100, it will again be understood that opposing forces exerted upon opposed surfaces of the plate-like valve bodies 102 and 104 negate one another, thereby providing a valve 100. Further, flow through the ports 62 and 72 is also balanced, with rotary action of the valve 50 as described above, causing an equal unseating of the valve bodies 102 and 104, producing an equalized flow through the ports 62 and 72.

The ports 62 and 72 need not be only fully open or closed, with a desired level of exhaust gas recirculation being produced by the ECU 25 in a manner predefined to allow a maximum instantaneous level of recirculation based on the sensed operating parameters of engine 16 without comprising optimal performance of the engine.

As described above the balanced flow EGR control apparatus of the present invention provides a number of advantages, some of which have been described above and others of which are inherent in the invention. Also, modifications may be proposed to the apparatus without departing from the teachings herein. Accordingly the scope of the invention is only to be limited as necessitated by the accompanying claims.

What is claimed is:

1. An internal combustion engine comprising:

a plurality of cylinder banks, each bank having an exhaust manifold and an associated exhaust passage fluidly separated from an exhaust passage of another bank, and an intake manifold shared with the other bank;

an exhaust gas recirculation valve apparatus comprising a housing having separate exhaust inlet ports connected exclusively respectively to each of said banks and a single outlet port communicating with the intake manifold, and a valve member including a linear valve stem upon which two plug valve bodies are mounted, each at a predetermined position there along so that each effectively seals one of said inlet ports from said outlet port, one of said valve bodies sealing said one inlet port from the inlet port side and the other of said valve bodies sealing the other of said inlet ports from the outlet port side, the valve stem being functionally engaged to an actuator;

and an engine ECU operatively associated with said actuator to cause the valve stem to unseat the valve bodies to open the inlet ports in a predetermined manner based on readings of operational parameters of the engine being monitored by the ECU.

2. The engine of claim 1 wherein the ports are not identically sized.

3. The engine of claim 2 wherein the valve bodies are not identically sized.

4. The engine of claim 3 wherein each valve body is sized sealingly engaged within a cooperating port.

5. The engine of claim 1 wherein the ports are linearly aligned and have entrances thereto separated from each other a specific distance.

6. The engine of claim 5 wherein the bodies of the valve are also separated from each other by the specific distance.

7. The engine of claim 6 wherein exhaust pressure forces from each engine bank act upon the respective valve body in a substantially similar, opposed manner, effectively canceling each other and maintaining the valve seated.

8. The engine of claim 7 wherein each valve body is configured in the form of a plate.

9. The engine of claim 8 wherein the valve stem is suited to rotary actuation.

10. The engine of claim 9 wherein the valve stem pivots out of alignment with the ports producing a balanced pivotal unseating of the valve bodies.

11. The engine of claim 2 wherein the valve stem incorporates a telescoping terminal section of predefined length extending outwardly of a main section thereof, with one valve body being suitably engaged to a free end of the telescoping terminal section and with another valve body being securely engaged to the main section.

12. The engine of claim 11 wherein said predefined length of said telescoping section of said valve stem is at least equal to the specific distance.

13. The engine of claim 12 wherein said predefined length is slightly greater than the specific distance.

14. The engine of claim 13 wherein a spring is engaged to and between said main section and said telescoping section of the valve stem, the spring biasing the telescoping section outwardly of the main section.

15. The engine of claim 14 wherein each valve body is configured in the form of an inverted hollow cone.

16. The engine of claim 14 wherein the valve stem is suited to linear actuation.

* * * * *